United States Patent [19]

Lautenschläger et al.

[11] 4,091,501

[45] May 30, 1978

[54] CANTILEVER HINGE

[75] Inventors: Karl Lautenschläger, Reinheim, Odenwald; Gerhard Lautenschläger, Brensbach-Wersau, both of Germany

[73] Assignee: Karl Lautenschläger KG Mobelbeschlagfabrik, Reinheim, Odenwald, Germany

[21] Appl. No.: 770,832

[22] Filed: Feb. 22, 1977

[30] Foreign Application Priority Data

Mar. 6, 1976 Germany ..... 2609413

[51] Int. Cl.[2] ..... E05D 3/08

[52] U.S. Cl. ..... 16/166

[58] Field of Search ..... 16/135, 163, 164, 165, 16/166, 173, 183, 178, 179

[56] References Cited

U.S. PATENT DOCUMENTS

| | | | |
|---|---|---|---|
| 1,864,164 | 6/1932 | Aldeen | 16/166 |
| 1,965,316 | 7/1934 | Predmore | 16/166 |
| 3,977,043 | 8/1976 | Zernig | 16/163 |
| 3,978,549 | 9/1976 | Vitt | 16/164 |
| 3,991,437 | 11/1976 | Friederichs et al. | 16/166 |

FOREIGN PATENT DOCUMENTS

| | | | |
|---|---|---|---|
| 1,559,815 | 1/1970 | Germany | 16/166 |
| 1,559,864 | 2/1970 | Germany | 16/166 |
| 1,759,611 | 11/1969 | Germany | 16/166 |
| 6,402,965 | 9/1964 | Netherlands | 16/163 |
| 343,837 | 2/1960 | Switzerland | 16/163 |
| 482,902 | 1/1970 | Switzerland | 16/163 |

*Primary Examiner*—James Kee Chi

[57] ABSTRACT

A knuckle joint hinge, especially for rabbeted doors of period furniture, having a supporting wall part and a door part, a knuckle joint mechanism joining together the two parts and having two link arms recoupled pivotingly with one another in their middle area, one of the ends of the link arms being coupled to the supporting wall part of the hinge in the one case and to the door part of the hinge in the other, while the other end in each case is coupled to the other hinge part either in a sliding guide or indirectly through a link. The articulation point of the link arm directly articulated to the door part of the hinge is provided immediately beside the edge of the door which is to be hinged and in front of the face edge of the supporting wall, and the parts of the door part of the hinge and of the link arm, which are visible when the door is closed, have the appearance of the articulation of a single-pivot hinge having visible sleeves joined by a hinge pin.

7 Claims, 6 Drawing Figures

14
22
4
58
36
44
32
16
34
10
28
24
26
30
52
54
56
50
20
40
38
42
18
12
64
6
60
62

CANTILEVER HINGE

BACKGROUND

The invention relates to a cantilever hinge, especially for paneled doors of period furniture, with a supporting wall part and a door part which are joined together by a knuckle joint mechanism formed by two arms coupled pivotingly together in their middle portion, one end of the one arm being articulated to the supporting wall part and one end of the other arm being articulated to the door part, while the other end in each case is coupled to the other hinge part, either in a sliding guide or indirectly by means of a link.

Cantilever hinges of this kind permit the door of a piece of furniture to open more than 90°—as a rule to as much as 180°—even when the door in question is laterally adjoined by projections or other cabinet doors. These hinges were developed to enable the doors of modern modular cabinets to open even when they are in space-saving abutment with the adjacent door; for this reason they are also known as 180° overlapping door hinges. In these modern modular cabinets, the doors are situated adjacent one another with a minimum of space between, and the hinges must be invisible, at least when in the closed state.

In the present state of the home decorating art, there is an increasing demand for furniture which is reminiscent of a bygone era, even though the consumer is not ready to dispense with the technical advantages of modern furniture. However, overlapping doors cannot be used in furniture adapted from antique styles. Instead, rabbeted doors are used, as a rule, with protruding frames or the like, which exclude the use of the more modern overlapping door hinges or canilever hinges for reasons of space and styling. The spatial difficulties lie in the fact that a door whose rabbeted portion is fitted into the interior of a cabinet requires a hinge motion which will provide for a considerably greater component of motion for the removal of the door leaf out of the cabinet if this door leaf is to be pivoted by 180° and must clear a projecting pilaster or an adjacent door possibly provided with projecting marginal decorations or carving. With the known cantilever hinges, such movements have not yet been achieved. Styling furthermore requires that the visible part of the hinge resemble the single—pivot hinges of the past, which had external sleeve-like joints which contained a hinge pin. Also, it is desirable that the joint, which is of elongated, cylindrical shape, and provided in some cases with decorative turned terminations, not merely consist of separately superimposed hardware imitating the joint, but actually perform functional duties of a hinge. Hinges of this kind, suitable for rabbeted doors for period-style furniture or for furniture having protruding moldings or pilasters, so as to enable the doors to be opened 180°, have not been available hitherto.

Theoretically, it would be conceivable to construct the well-known single-pivot hinge such that the door leaf, upon opening, would emerge from the door opening by the necessary amount, so that a pivoting movement of 180° would be possible with clearance of adjacent pilasters or of an adjacent door with projecting carvings; to this end, however, the pivot point would have to be located far out from the supporting wall and the door frame, which not only is unattractive, but also dangerous since the clothing of uncautious persons can catch on the projecting joints.

THE INVENTION

The invention is addressed to the task of creating a hinge for the applications discussed herein, i.e., for period furniture with rabbeted doors and possibly raised door frames or projecting carving, or for laterally projecting moldings, which will permit the door to be swung 180° from the closed position to the open position to a point in front of an adjacent door or in front of the molding, while preserving the appearance of the old, familiar single-pivot hinges with exposed articulation, while the visible, exposed articulation will not project beyond the adjacent door frame or molding.

Setting out from a cantilever hinge of the initially mentioned kind, this task is accomplished in accordance with the invention in that the articulation point of the arm pivotingly linked directly to the door part of the hinge is provided directly adjacent the margin of the door to be hung and in front of the face end of the supporting wall, and that the parts of the cantilever joint and of the door part of the hinge which are visible when the door is shut are constructed to resemble the hinge joint of a single-pivot hinge having visible knuckles joined by a hinge pin. Thus, a pivot point formerly located in the door part of the hinge which was recessed into the door is placed alongside the door and is stylized in the desired manner.

In an advantageous further development of the invention, in which the supporting wall part of the hinge can be fastened adjustably on a mounting plate placed on the inside of the supporting wall, the hinge is so designed that the supporting wall part of the hinge, which can be fastened in its rearward area on the mounting plate, is step-shaped in its area forward of the mounting plate such that it will be located in an elongated rabbet in the edge of the supporting wall, and so that the link arm articulated directly on the supporting wall part of the hinge will be articulated in this forward area of the supporting wall part of the hinge within the elongated recess provided in the latter. Thus, some of the articulation points which in the known cantilever hinges were located in front of the inner supporting wall, i.e., in the open interior of the cabinet, have now been shifted into the rabbet in the wall of the cabinet.

The link arm directly articulated on the door part of the hinge is then given a dog-leg shape corresponding approximately to the stepped shape of the supporting wall part of the hinge, so that the forward portion of the link arm will likewise be located in the rabbet in the supporting wall and will project from the rabbet at the front edge of the supporting wall, there forming part of the visible joint.

It is recommendable to construct the link arm articulated on the door part of the hinge of two parallel plates joined integrally together by a cross member in their rearward area such that the link arm will, in the closed position, overlap the supporting wall part of the hinge in the U-shaped cross sectional area formed of the plates and the cross member. The link arm thus becomes especially sturdy.

The link arm articulated directly to the door part of the hinge can then be guided in its rearward area by a guide means sliding in grooves in the supporting wall part of the hinge, in a known manner, pins pointing inwardly from the lateral plates engaging lateral grooves in the supporting wall part of the hinge.

Alternatively, the link arm articulated directly to the door part of the hinge can be linked indirectly to the supporting wall part of the hinge by a link, in a known manner. This construction can be adopted when the hinge is to be constructed as an overcenter hinge. This indirect articulation of the link arm can then, in accordance with German Offenlegungsschrift No. 2,219,616, be equipped with a U-shaped closing spring, which is disposed on this link so that its closed end passes around the pivot pin joining the link to the link arm. One leg of the spring is then supported on the link, while the other presses against a guide track provided on the supporting wall part of the hinge, the said track being shaped so as to achieve the desired closing action.

In the cantilever hinge of the invention, the link arm articulated directly to the supporting wall part of the hinge is preferably coupled to the door part of the hinge by a link articulated at one end to the link arm and at the other end to the door part of the hinge, the hinge end of the link being joined pivotingly, when the hinge is in the closed state, to the door part of the hinge directly behind the point at which the other link arm is articulated to the said door part of the hinge. In the door-closed position, the link is then again located largely in the elongated rabbet in the supporting wall and between the plates of the other link arm.

The door part of the hinge can have a comparatively simple construction by being provided with a threaded stem extending outwardly from the visible part at right angles to the pivot axis of the link arm articulated to it, the said threaded stem being able to be screwed into a bore provided in the door edge and extending parallel to the flat sides of the door. It is then relatively simple to align the door by screwing the threaded stem more or less deeply into the corresponding bore.

Alternatively, the door part of the hinge can also be constructed in the form of a known mortised cup laterally adjoining the visible part, which can be inserted into a mortise cut in the back of the door with an opening in the edge of the door, and can be fastened in the said rabbet. This cup is of comparatively simple construction, since, unlike the conventional cantilever hinges, it does not accommodate the pivot points for the hinge links or link arms.

The invention will be explained hereinbelow in conjunction with the drawing, wherein.

Figure 1:
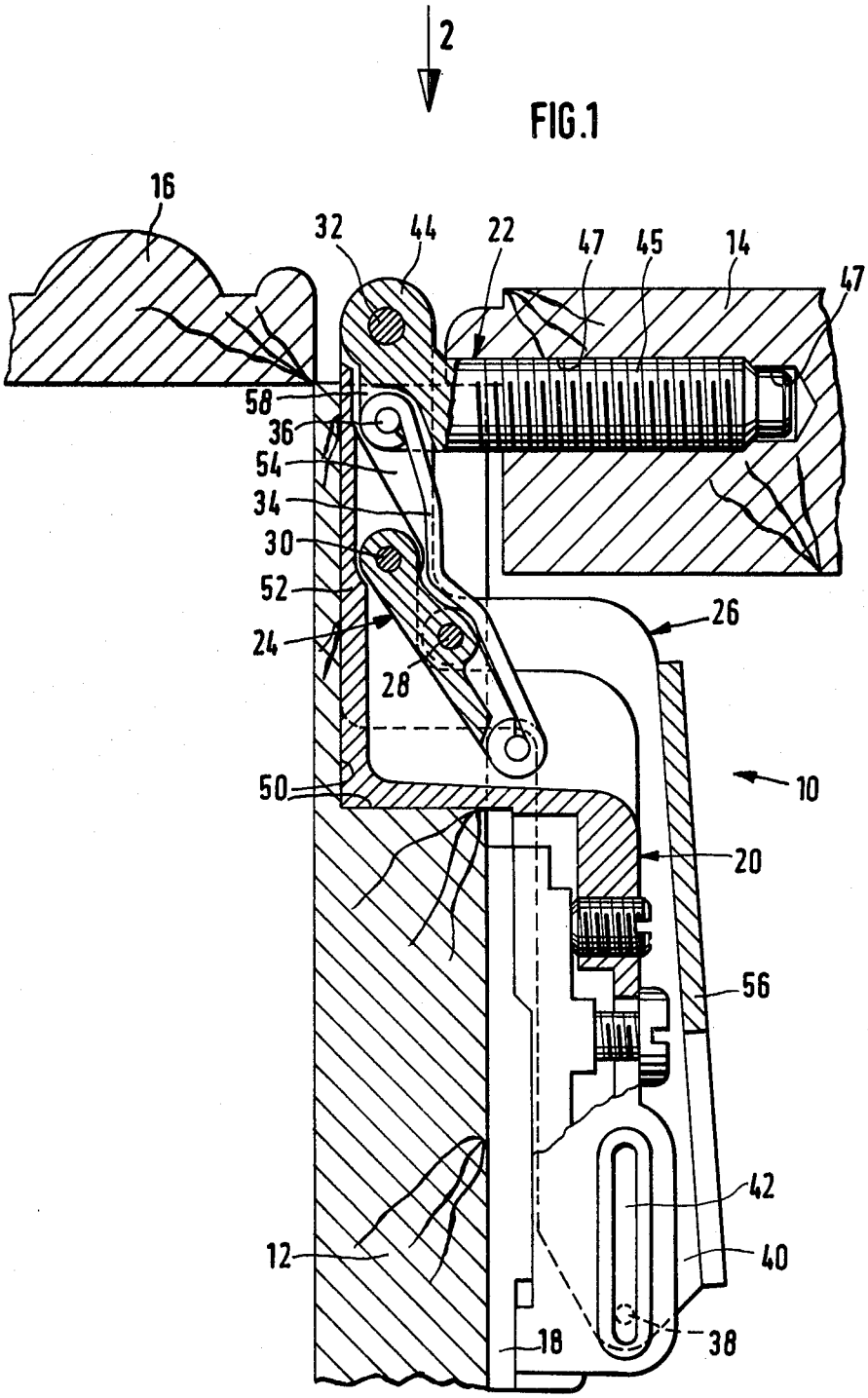
FIG. 1 is a top cross-sectional view of a cantilever hinge in accordance with the invention in the closed state.
Figures 3, 5, 6:
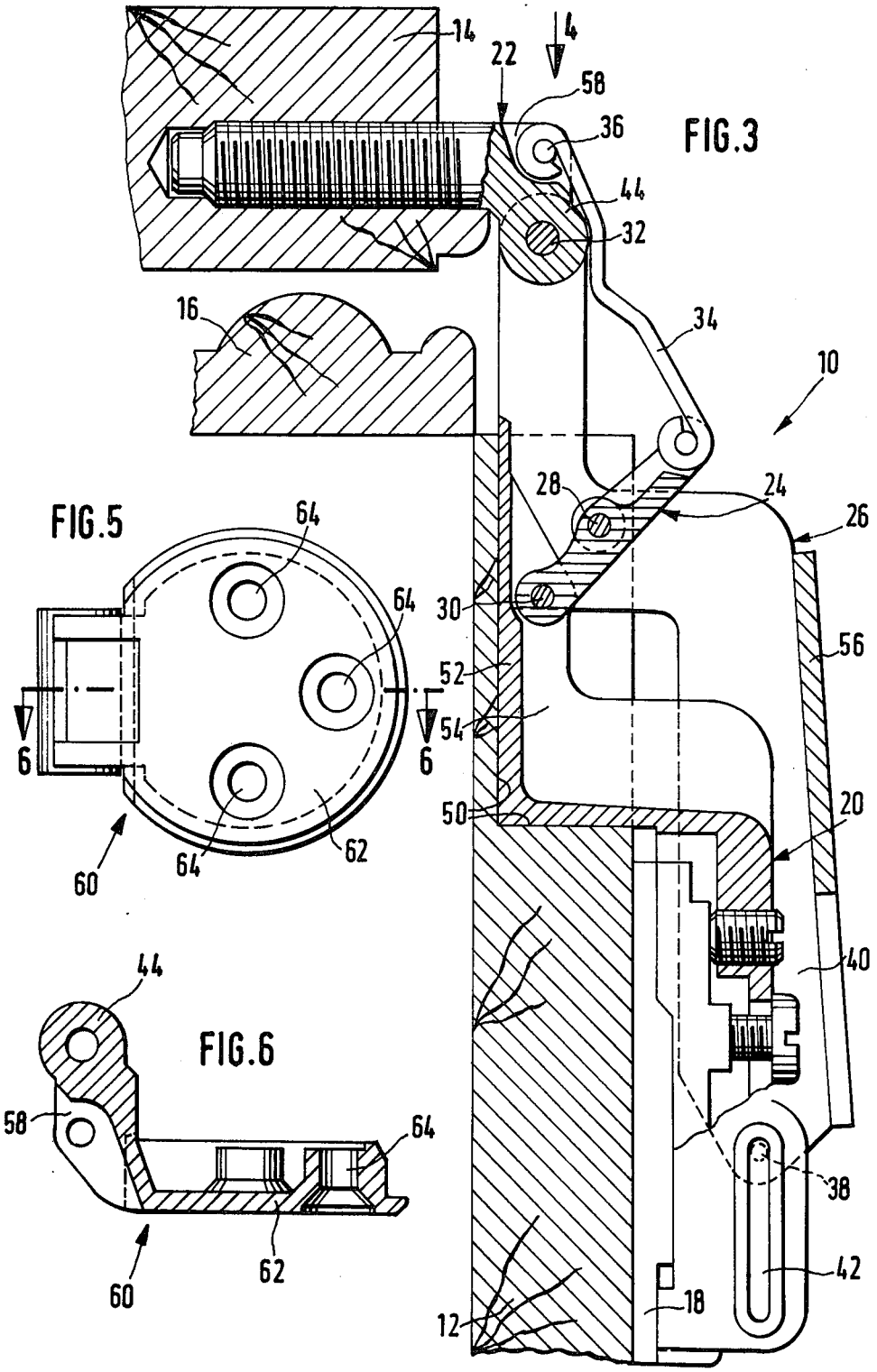
FIG. 3 is a cross-sectional view, corresponding to FIG. 1, showing the hinge of the invention swung into the open position at 180°.
FIG. 5 is a front view of a door part of the cantilever hinge of the invention, which differs from the door part shown in FIGS. 1 and 3.
FIG. 6 is a cross-sectional view taken along line 6—6 of FIG. 5.

The embodiment of a cantilever hinge 10 in accordance with the invention which is shown in FIGS. 1 and 3 serves for fastening to the supporting wall 12 of a cabinet a door 14 which is constructed as a rabbeted door in the case illustrated. The door, which is provided with a marginal bead on the outside face, can swing 180° from the closed position shown in FIG. 1 to the open position shown in FIG. 3, in which the door is located parallel with and facing a lateral frame member 16 or another door, it being indicated diagrammatically that the lateral member 16 can also have projecting moldings. To prevent the door 14 from interfering laterally, a movement away from the interior of the cabinet must be superimposed upon the pivoting movement produced when it is opened. The magnitude of this additional movement is greater than in the case of the overlapping doors of modern modular cabinets which open 180°, in which the door needs to be shifted only by the thickness of the adjacent door, because, as stated, it is a rabbeted door whose inside face is recessed considerably into the cabinet, while the decorations on the door 14 and on the adjacent frame component 16 project from the face of the cabinet by an amount that is greater than the thickness of modern overlapping doors.

The cantilever hinge 10 of the invention has a supporting wall part 20 which is removably and adjustably fastened on a mounting plate 18 installed on the supporting wall 12, and a door part 22 fastened to the door 14, these parts being coupled together by a knuckle joint mechanism formed by two link arms 24 and 26 joined pivotingly together in their central area by a pivot pin 28. The link arm 24 is articulated at one end by means of a pivot pin 30 to the supporting wall part 20 and the other link arm 26 is articulated to the door part 22 by means of a pivot pin 32.

At the other, swinging end of the link arm 24 there is articulated a link 34 whose other end is articulated at 36 to the door part 22 of the hinge, and couples the link arm 24 indirectly with the door part in this manner.

The second end of the link arm 26, however, is guided slidingly on the supporting wall part 20 of the hinge by a slide guide. The slide guide is formed by short, inwardly pointing pins 38 along the inner sides of lateral, parallel plates 40 of the link arm 26, which engage in elongated external slide grooves 42 in the supporting wall 20. Up to this point, the hinge is fundamentally the same as known cantilever hinges.

Figure 2:
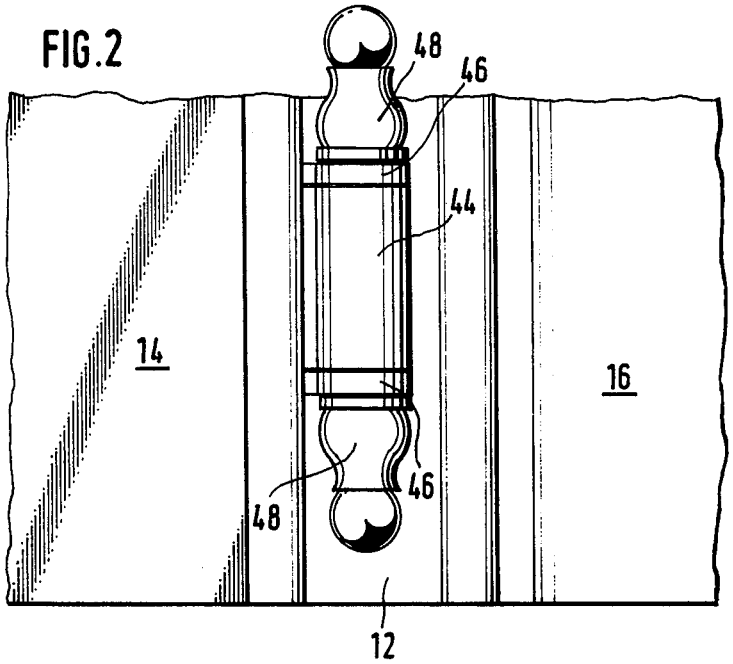
FIG. 2 is a front elevational view of the portion of the cantilever hinge which is visible when the door is closed, as seen in the direction of arrow 2 of FIG. 1.

In contrast to the known cantilever hinges, however, a portion 44 of the door part 22 of the hinge is visible, and, as seen from the front, it has the form of an elongated sleeve (FIG. 2), which covers the hinge pin 32 whereby the link arm 26 is articulated on the door part 22 of the hinge. The sleeve-like portion 44 has a length corresponding to the space between the plates 40 of the link arm 26 at the front end, and lies between the ends 46 of plates 40, which are rounded off to the radius of the sleeve-like portion 44. The hinge pin 32 (FIG. 1) which passes through the sleeve-like portion 44 and through bores in the ends 46 of the plates 40 of the link arm 26, projects at both ends slightly beyond the outsides of the plates 40 and bears superimposed turned or embossed decorative buttons 48, which, in conjunction with the ends 46 of the plates 40, give the visible part 44 the desired antiquated appearance of the formerly used single pivot hinges. The fastening of the sleeve-like part 44 of the door part 22 to the door is performed by means of a threaded stem 45 of sufficient length which is mounted at right angles to the bore for the hinge pin 32, and which can be threaded into a corresponding bore 47 in the door.

To cause the hinge parts which are visible when the door is closed and which are located directly in front of the end face of the supporting wall 12 to move forward away from the supporting wall, a rabbet 50 facing the door is cut in the edge of the supporting wall 12 adjacent the joint formed by the sleeve-like portion 44 of the door part of the hinge and the ends 46 of the link arm 26, and accommodates the front section 52 of the supporting wall part 20 of the hinge and the front sections 54 of the plates 40 of the link arm 26. In order to bring the rear section of the supporting wall part 20 of the hinge and the rear section of the link arm 26 which is borne in the slide guide of this same hinge part into the required inwardly withdrawn position, the supporting wall part 20 of the hinge and the plates 40 of the link arm 26 are given the offset shape which is seen in FIGS. 1 and 3.

The section 52 of the supporting wall part 20 of the hinge, which is located in the rabbet 50, is of a U-shaped cross section, the pivot pin 30 for the one end of the other link arm 24 being held in bores in the lateral limbs of the U. The link arm 26 is also of a U-shaped cross section in its rearward portion inasmuch as the two plates 40 are joined by a cross member 56.

Figure 4:
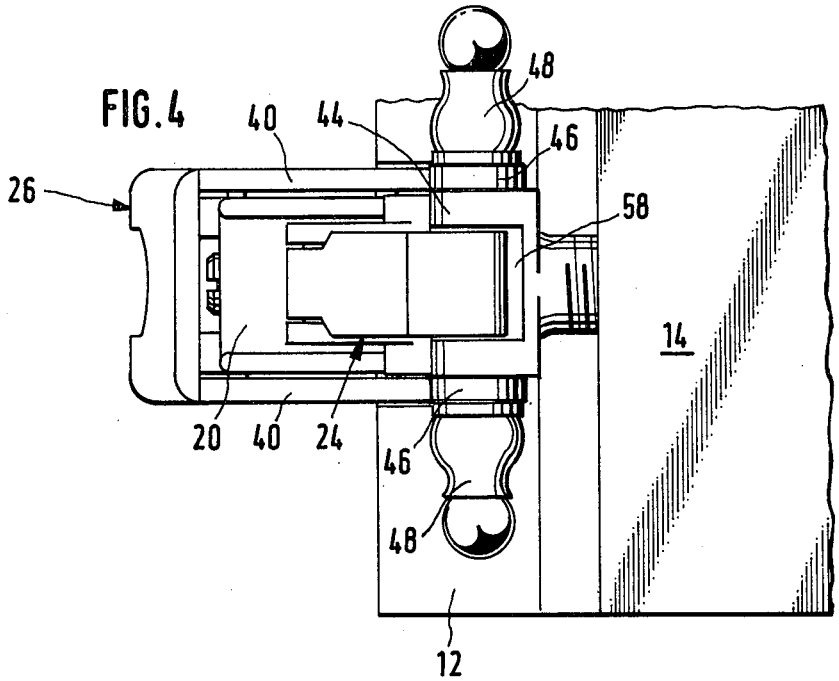
FIG. 4 is an elevational view taken in the direction of the arrow 4 in FIG. 3.

The link 34 joining the second end of the link arm 24 to the door part 22 of the hinge is—as already mentioned—attached pivotingly to a pin in a recess 58 in the sleeve-like portion 44 of the door part 22, the said recess 58 and the pin being located directly behind the hinge pin 32 when the hinge 10 is in the closed state (FIG. 1). In the open state, the recess 58 is pivoted 180° forwardly, so that the pivot point 36 is visible (see FIG. 3 and especially FIG. 4).

In FIGS. 5 and 6 there is shown a variant embodiment of a door part 60 which differs from the door part 22 described in conjunction with FIGS. 1 to 4 in that, instead of the threaded stem 45, a mortise cup 62 is provided, which can be fastened in a matching mortise (not shown) in the back of the door 14. Since in this door part 60 a visible sleeve-like portion 44 is also provided, which is mounted laterally on a flat portion of the otherwise circular-shaped mortise cup 62, the mortise in door 14 must be open at the edge of the door. The mortise is quite simply made by means of an end mill whose diameter corresponds to the diameter of the mortise cup, the end mill being located on the back of the door when cutting the mortise so that it slightly overlaps the inner, rabbeted edge of the door 14 and thus produces the required lateral opening. Three countersunk bores 64 serve to accommodate flat-head screws (not shown) with which the mortise cup 62 is fastened into the door mortise. Instead of the screw fastening, the mortise cup 62 might also be in the form of a hammer-in cup, in a known manner, or have expansible circumferential walls in the manner of an expansion bolt.

It is apparent that, with the hinge described above, a cantilever hinge is created for the first time which fulfills the requirements of period-style furniture both as regards its appearance and as regards its operation.

We claim:

1. Knuckle joint hinge, especially for rabbeted doors of period furniture to be opened up to an angle of 180°, said hinge having a supporting wall part and a door part, a knuckle joint mechanism joining together said supports and having two link arms recoupled pivotingly with one another in their middle area, one of the ends of the link arms being coupled to the supporting wall part of the hinge in the one case and to the door part of the hinge in the other, while the other end in each case is coupled in a sliding guide or indirectly through a link to the other hinge part, the supporting wall part of the hinge being adapted to be fastened to a mounting plate mounted adjustably on the inside of the supporting wall, the supporting wall part of the hinge, which is adapted to be fastened in its rearward area on the mounting plate, being bent twice in opposite directions in its forward area ahead of the mounting plate, such that, in this forward area, it lies in an open-fronted, elongated recess provided in the supporting wall, the link arm directly articulated to the supporting wall part of the hinge being articulated to the supporting wall part of the hinge in said forward area of the supporting wall part of the hinge within the elongated recess, said link arm directly articulated to the door part of the hinge being bent twice contrariwise corresponding approximately to the supporting wall part of the hinge, so that the forward area of the link arm likewise lies in the elongated recess in the supporting wall and protrudes from the recess at the face edge of the supporting wall, the articulation point of the link arm directly articulated to the door part of the hinge being provided immediately beside the edge of the door which is to be hinged and in front of the face edge of the supporting wall, the parts of the door part of the hinge and of the link arm, which are visible when the door is closed, comprising a hinge pin and visible sleeves joint by said pin to thereby present the appearance of the articulation of a single-pivot hinge.

2. A knuckle joint hinge according to claim 1, wherein the link arm directly articulated to the door part of the hinge is formed of two turned-down cheeks running parallel at a distance from one another, a cross wall joining said cheek integrally in the rearward area thereof such that the link arm overlaps the supporting wall part in the U-shaped cross-sectional area formed of the cheeks and the cross wall.

3. A knuckle joint hinge according to claim 2, comprising a sliding guide means in slide grooves in the supporting wall part of the hinge guiding the link arm directly articulated to the door part of the hinge in its rearward area.

4. A knuckle joint hinge according to claim 2, comprising a link articulating the link arm directly articulated to the door part of the hinge indirectly on the supporting wall part of the hinge.

5. A knuckle joint hinge according to claim 1, wherein a link indirectly couples the link arm articulated directly to the supporting wall part of the hinge with the door part of the hinge, said link being mounted pivotingly on the link arm at one end and on the door part of the hinge at the other end, the hinge-part end of the link in the closed position of the hinge being pivotingly connected to the door part of the hinge directly behind the point at which the other link arm is attached to the door part of the hinge.

6. A knuckle joint hinge according to claim 5, wherein the door part of the hinge has a threaded stem projecting its visible part at right angles to the pivot axis of the link arm pivoted thereon, said threaded stem being able to be screwed into a bore made in the door from the edge of the door, parallel to the flat sides of the door.

7. A knuckle joint hinge according to claim 1, wherein the door part of the hinge is constructed as a mortise cup laterally adjoining the visible part, said cup being fastenable in a recess cut in the rear side of the door and opening towards the edge of the door.

* * * * *